US006361603B1

(12) United States Patent
Salomon

(10) Patent No.: US 6,361,603 B1
(45) Date of Patent: Mar. 26, 2002

(54) APPARATUS FOR MOISTENING ENVELOPE FLAPS

(75) Inventor: James A. Salomon, Cheshire, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/573,275

(22) Filed: May 18, 2000

(51) Int. Cl.[7] ..... B05B 15/00; B43M 5/02
(52) U.S. Cl. ..... 118/300; 118/315; 156/441.5
(58) Field of Search ..... 118/300, 312, 118/313, 315, DIG. 16, 257, 324, 264; 156/441.5, 578

(56) References Cited

U.S. PATENT DOCUMENTS

| | | | | | |
|---|---|---|---|---|---|
| 2,031,055 | A | * | 2/1936 | McKinney | 261/30 |
| 3,884,745 | A | * | 5/1975 | Sette et al. | 156/441.5 |
| 3,911,862 | A | | 10/1975 | Lupkas | 118/7 |
| 4,873,941 | A | | 10/1989 | O'Dea | 118/669 |
| 4,924,804 | A | | 5/1990 | O'Dea et al. | 118/669 |
| 4,924,805 | A | | 5/1990 | O'Dea | 118/680 |
| 5,007,371 | A | | 4/1991 | O'Dea et al. | 118/680 |
| 5,098,734 | A | | 3/1992 | O'Dea et al. | 427/8 |
| 5,252,353 | A | | 10/1993 | DiGiulio et al. | 427/8 |
| 5,527,418 | A | | 6/1996 | Ginsberg | 156/443 |
| 5,665,198 | A | | 9/1997 | Bieber et al. | 156/578 |
| 5,681,757 | A | | 10/1997 | Hayes | 437/7 |
| 5,740,728 | A | | 4/1998 | DeBarber et al. | 101/93 |
| 5,813,327 | A | | 9/1998 | Freeman et al. | 101/93 |
| 5,840,123 | A | | 11/1998 | Holbrook | 118/603 |
| 6,221,159 | B1 | * | 4/2001 | Gregoire et al. | 118/264 |

* cited by examiner

*Primary Examiner*—Richard Crispino
*Assistant Examiner*—Yewebdar T Tadesse
(74) *Attorney, Agent, or Firm*—Alberta A. Vitale; Charles R Malandra; Angelo N. Chaclas

(57) ABSTRACT

This invention overcomes the disadvantages of the prior art by providing a non-contact apparatus for moistening envelope flaps that projects moistening fluid without pumping fluid. The present invention is directed to, in a general aspect, a non-contact envelope flap moistening apparatus which can be installed in a mailing machine apparatus. The apparatus for delivering moistening fluid to an envelope flap comprises: a reservoir containing the moistening fluid; a media partially submerged in the moistening fluid contained in the reservoir; the media wicking a portion of the moistening fluid as the media is moved through the reservoir and the moistening fluid; a drive means operably connected to the media for moving the media through the reservoir; a projecting means for projecting moistening fluid from the media, the projecting means positioned adjacent to the media on a side opposite the envelope flap, and near a portion of the media that is not submerged in the reservoir; and whereby when the projection means affects the media, a portion of the moistening fluid that has been wicked by the media is dislodged from the media forming droplets that travel to and moisten the envelope flap. The projecting means may be a nozzle connected to an air source for blowing air toward the media and towards the envelope flap or it may be an actuator for causing vibration of the media and causing projection of moistening fluid from the media.

20 Claims, 5 Drawing Sheets

APPARATUS FOR MOISTENING ENVELOPE FLAPS

FIELD OF THE INVENTION

The invention disclosed herein relates generally to a method and apparatus for moistening gummed envelope flaps and, more particularly, to a non-contact apparatus for application of moisture to gummed envelope flaps.

BACKGROUND OF THE INVENTION

Envelope flap moistening systems generally fall into two categories: contact and non-contact moistening systems. Contact systems generally deposit moisture onto an envelope flap by contact with a wetted substrate. Non-contact systems generally spray moisture onto the envelope flap. In non-contact flap moistening systems, envelope flap moistening has been performed with nozzle and pump systems. The pump, which is connected to a reservoir, draws fluid from the reservoir and sprays the fluid through the spray nozzles.

In contact systems, the moisteners typically consist of contact media such as brushes, manifolds, foam or felt. Contact moisteners wick moistening fluid and distribute it onto a gummed envelope flap by making contact with the flap. The nature of contact systems make them subject to wear and sensitive to envelope flap deformations such as curl. Curled flaps can cause incomplete contact which leads to incomplete sealing. Contact systems tend to lose their wicking ability due to contamination of the media by the envelope gum and paper dust and also due to wear of the contact media from repeated abrasions. Additionally, contact systems need to provide contact between the glue line and the contact media for a particular time period in order for the glue to become sufficiently moistened for sealing.

Non-contact systems with pumps and nozzles can be open flap systems or closed flap systems. An open flap system is one in which the envelope flap is substantially open approximately 30° to 60° to the envelope. A closed flap system is one in which the envelope flap is opened slightly and a wick or nozzle array applies fluid at a close range onto the flap. In closed flap systems, there is a risk of contact between the nozzle and the envelope flap which causes contamination of the nozzles with envelope gum. Additionally, in pump and nozzle systems, fluid such as water is pumped through the nozzles. The pump requires a filter to protect the pump valves from paper fiber contamination, bacteria and other contaminates that can be present in the fluid. In fluid pumping systems, the pump always needs to be primed. In systems where fluid is being pumped intermittently, priming of the pump is critically important for reliably moistening each envelope flap. Fluid pumping system costs are high due to the need to reliably pump and filter the moistening fluid.

Thus, one of the problems of the prior art is that the contact systems and non-contact systems are subject to contamination. Another problem of the prior art is that nozzle and pump flap moistening systems are dependent upon the pump being primed. Another problem of the prior art is that nozzle and pump systems are expensive. Another problem of the prior art is that contact systems are sensitive to flap deformation. Another problem of the prior art is that contact systems are subject to wear. Another problem of the prior art is that contact systems require long contact periods in order to moisten the flap sufficiently.

SUMMARY OF THE INVENTION

This invention overcomes the disadvantages of the prior art by providing a non-contact apparatus for moistening envelope flaps that projects moistening fluid without pumping fluid. The present invention is directed to, in a general aspect, a non-contact envelope flap moistening apparatus which can be installed in a mailing machine apparatus. The apparatus for delivering moistening fluid to an envelope flap comprises: a) a reservoir containing the moistening fluid; b) a media partially submerged in the moistening fluid contained in the reservoir, the media wicking a portion of the moistening fluid as the media is moved through the reservoir and the moistening fluid; c) a drive means operably connected to the media for moving the media through the reservoir; d) a projecting means for projecting moistening fluid from the media, the projecting means positioned adjacent to the media on a side opposite the envelope flap and near a portion of the media that is not submerged in the reservoir; and e) whereby, when the projection means affects the media, a portion of the moistening fluid that has been wicked by the media is dislodged from the media forming droplets that travel to and moisten the envelope flap. The projecting means may be a nozzle connected to an air source for blowing air toward the media and the envelope flap, or it may be an actuator for causing vibration of the media and causing projection of moistening fluid from the media.

Thus, an advantage of the method of the present invention is that it accomplishes flap moistening without pumping fluid. Another advantage of the present invention is that the air source does not require expensive filtering since it is not subject to contamination. Another advantage of the present invention is that it is less costly. Another advantage of the present invention is that it is not subject to wear from contact with envelope flaps. Another advantage of the present invention is that it is not sensitive to mailpiece deformation. Another advantage of the present invention is that it does not require contact time for moistening. Other advantages of the invention will in part be obvious and will in part be apparent from the specification. The aforementioned advantages are illustrative of the advantages of the various embodiments of the present invention.

DETAILED DESCRIPTION OF THE PRESENT INVENTION

Figure 1A:
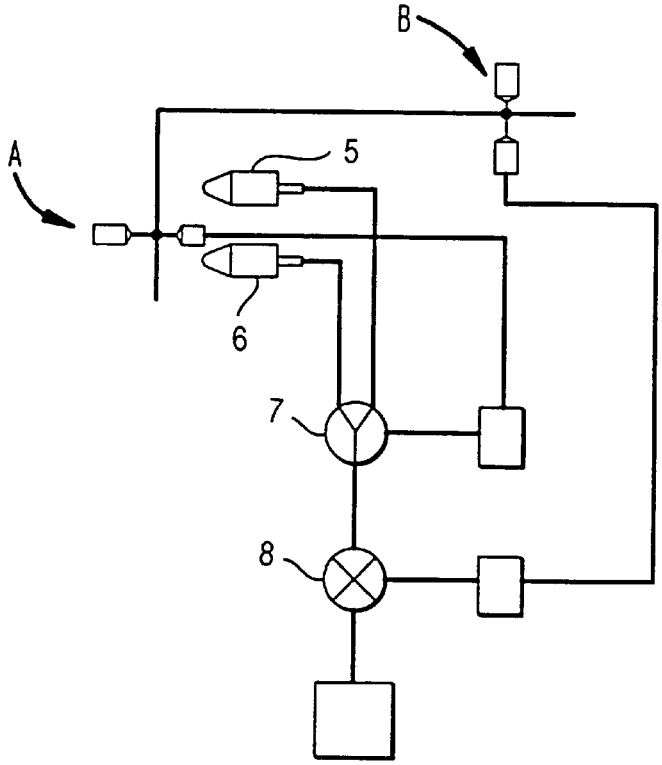
FIG.1a ( PRIOR ART )
FIG. 1*a* is a schematic diagram of a prior art system employing multiple nozzles, a pump and a solenoid actuated valve for envelope flap moistening.
Figure 1B:
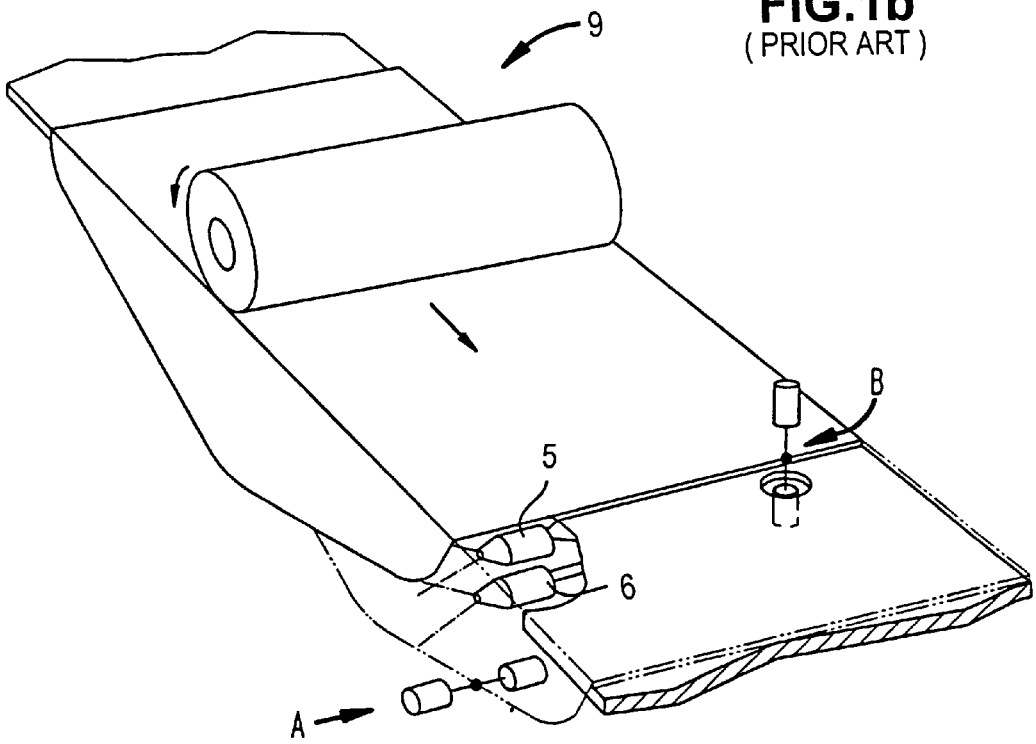
FIG.1b ( PRIOR ART )
FIG. 1*b* is a perspective view of a prior art system showing placement of the nozzles in a mailing machine apparatus.

FIG. 1*a* is schematic diagram of a prior art system employing multiple nozzles 5 and 6, a pump 8 and a solenoid actuated valve 7 for envelope flap moistening. FIG. 1*b* is a perspective view of a prior art system showing placement of the nozzles in a mailing machine apparatus 9. The envelope sensing system, including envelope flap sensor A and envelope sensor B, is designed for sensing flap profiles. The solenoid actuated valve 7 placed between the pump and the nozzle(s) controls spraying. The pump of the prior art system is connected to a reservoir and pumps fluid to the envelope flap.

In describing the present invention, reference will be made herein to FIGS. 2–5 of the drawings in which like numerals refer to like features of the present invention.

Figure 2A:
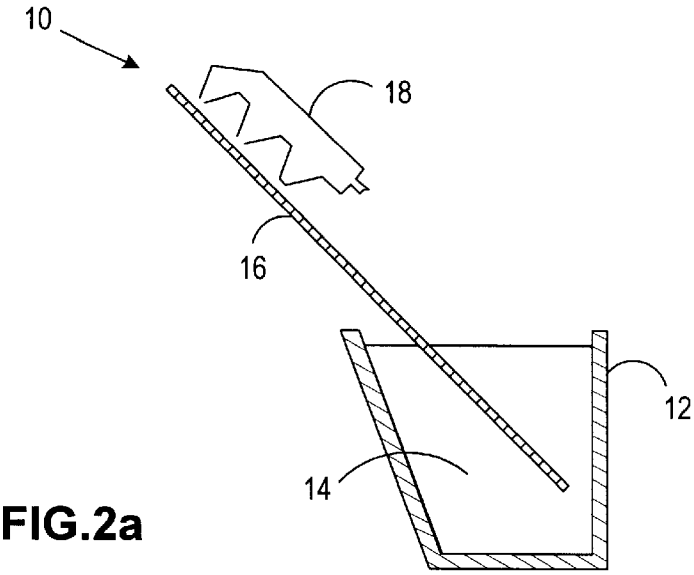
FIG. 2*a* is a simplified side view of an embodiment of the apparatus of the present invention.

FIG. 2*a* is a simplified side view of an embodiment of the apparatus 10 of the present invention which pumps air to facilitate envelope flap moistening. The apparatus 10 may be mounted in a mailing machine (not shown). The envelope flap moistening apparatus 10 can be installed in a mailing machine apparatus, such as, a mailing machine disclosed in U.S. Pat. No. 5,740,728 which is assigned to the assignee of the present invention and is herein incorporated by reference. The apparatus 10 comprises a reservoir 12 containing moistening fluid 14, a disk 16 and a nozzle 18 attached to an air pump or compressor (not shown). The moistening fluid 14 may be water or EZ-seal® (a sealing solution sold under the trademark and sold by Pitney Bowes Inc., the assignee of the present application), or other suitable fluid. The disk 16 is a porous mesh (in empirical testing the mesh was preferably polyester with a mesh count of approximately 20 per linear inch and the moistening fluid was water) or screen and is rotated by a transport device such as a drive motor 26 and belt 30 (shown in FIG. 3). The pump may be an inexpensive diaphragm pump such as one typically used to aerate an aquarium. The preferred air pressure is less than 5 psi.

The mesh size of the porous disk 16 may be determined by one of ordinary skill in the art. The mesh count should be small enough so that tiny droplets of fluid are formed in the mesh for subsequent deposit on the envelope flap 20. The size of the droplets is a function of the moistening fluid characteristics such as surface tension, the mesh geometry, wetting characteristics of the mesh, the nozzle shape and the air pressure.

The disk 16 may be continuously or intermittently rotated through the moistening fluid. The continuous rotation would increase the reliability of the apparatus. It would also increase the amount of evaporation of the moistening fluid. The pump may be on continuously or work in conjunction with a flap sensor to spray air intermittently when the envelope flap is sensed. An envelope position sensor may be used for detecting the position of the envelope in the mailing machine. The envelope position sensor can provide signals indicative of envelope position to a system controller (not shown). The system controller can provide a signal to the pump to blow or not blow air toward the mesh. The system controller could also rotate or not rotate the disk. The sensor and controller could be implemented by one of ordinary skill in the art.

Figure 2B:
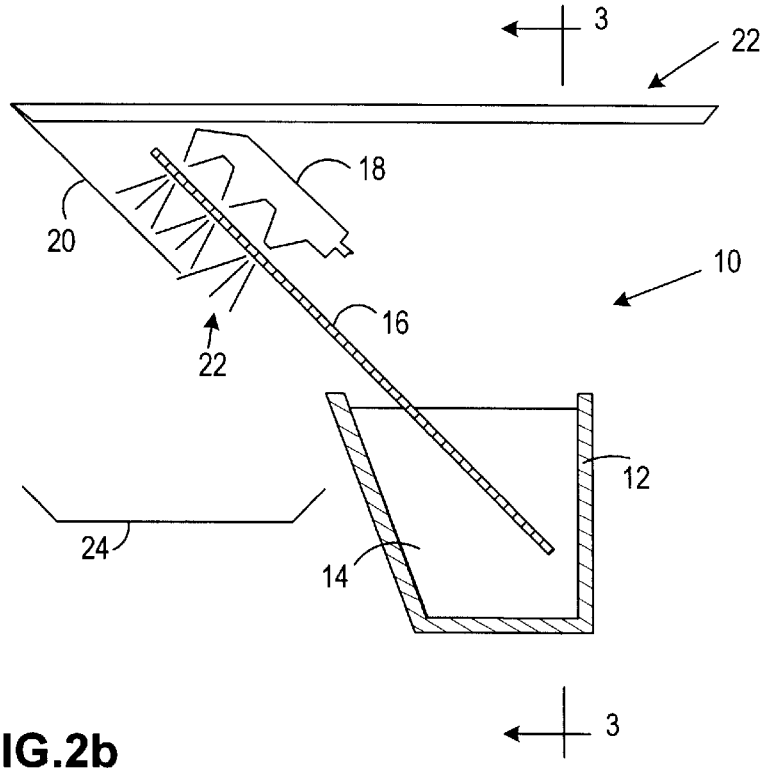
FIG. 2*b* is a simplified side view of an embodiment of the apparatus of the present invention illustrating the delivery of fluid to an adjacent envelope flap.

FIG. 2*b* is a simplified side view of an embodiment of the apparatus 10 of the present invention illustrating the delivery of fluid to an adjacent envelope flap 20. The disk 16 is rotated via the drive motor 26 (shown in FIG. 3), through the reservoir 12 where it captures sealing fluid 14 from the reservoir 12 into the pores of the disk 16, and brings it past the nozzle 18. The nozzle 18 provides an air stream to project small droplets 21 of fluid 14 from the disk to the envelope flap 20. While one nozzle is shown in FIGS. 2–5, it should be understood that multiple nozzles and various nozzle geometry may be used as determined by one of ordinary skill in the art. The spray nozzle 18 is configured to direct a mist of fluid 14 to moisten the flap 20 of an envelope 22. The spray is directed toward the gummed area of the flap 24. The volume of air blown through the nozzle 18 can be modulated to control moistening when mail is stalled or being run through a mailing machine at a slower rate. The over-spray may be collected using a fluid collection system 24 such as a tray beneath the nozzle 18. A guide (not shown) could be included with the apparatus so the gap between the flap and disk 16 is controlled to the range of the projected droplets. The guide also prevents contact between the disk 16 and the envelope flap 24.

Figure 3:
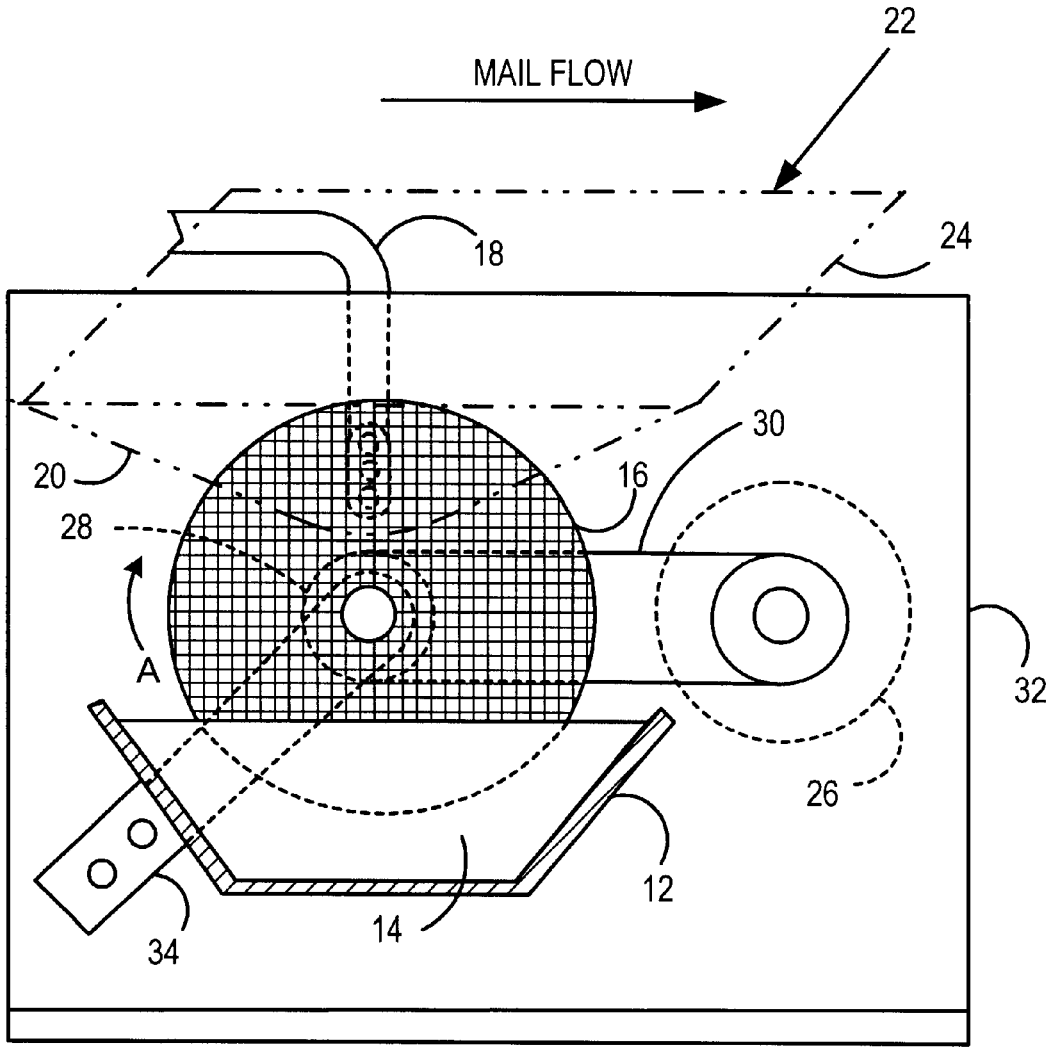
FIG. 3 is a view of an embodiment of the apparatus of the present invention along line 3—3 of FIG. 2*b* also including drive mechanism and frame.

FIG. 3 is a view of an embodiment of the apparatus of the present invention along line 3—3 of FIG. 2*b* also including drive mechanism and frame. FIG. 3 illustrates the direction of movement of envelope 22 and the direction of movement of disk 16 (shown by arrow A). It should be noted that the direction of movement of disk 16 is shown for illustration purposes only and that in application, the direction of movement of disk 16 may be counterclockwise or clockwise. In the preferred embodiment, a drive motor 26 drives the disk 16 via a pulley 28 and belt 30 mechanism. The disk and pulley are fastened to a frame 32 with a fastener mechanism 34.

Figure 4:
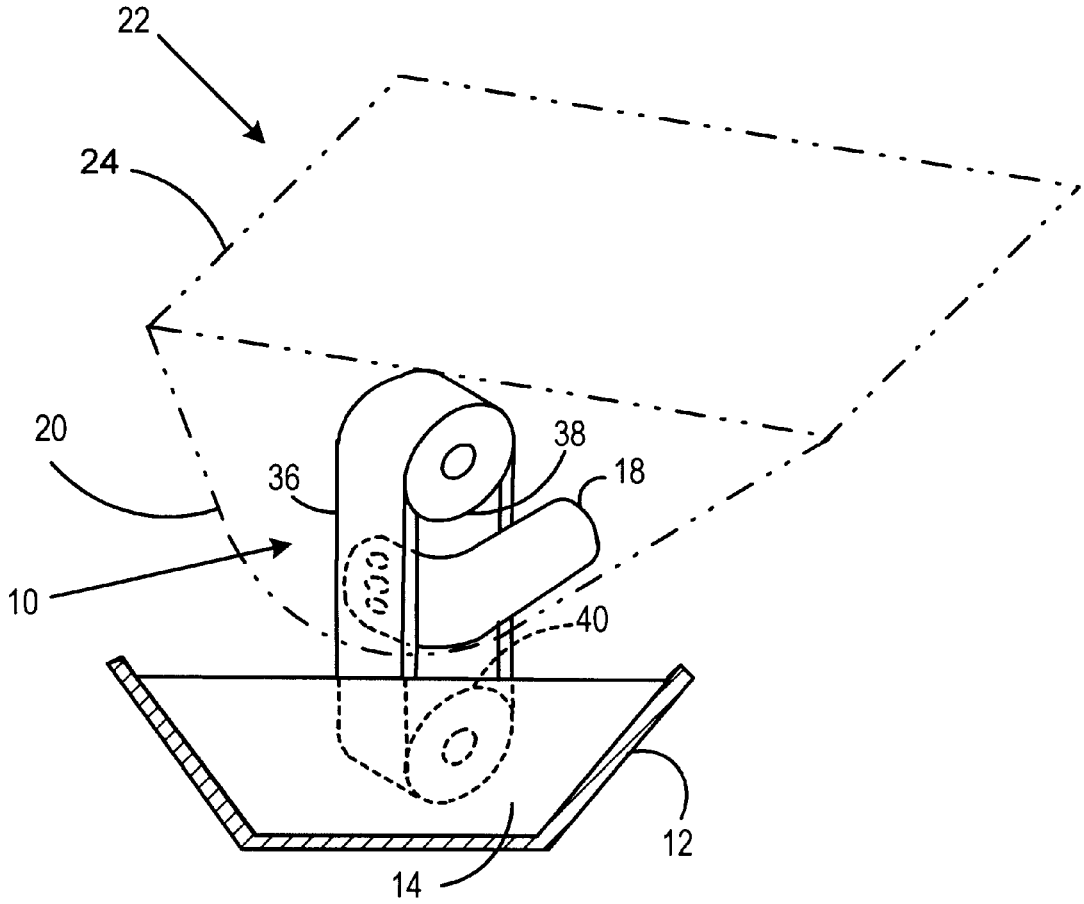
FIG. 4 is a simplified perspective view of an alternate embodiment of the apparatus of the present invention.

FIG. 4 is a simplified perspective view of an alternate embodiment of the apparatus of the present invention. The disk 16 (shown in FIGS. 2*a*, 2*b* and 3) is replaced with a continuous belt 36 made of a porous material. The apparatus 10 comprises a reservoir 12 containing fluid 14, a porous belt 36, a drive wheel 38 and driven wheel 40 for moving the continuous porous belt 36. For simplification, the drive motor for driving the continuous porous belt 26 is not shown. The apparatus further comprises a nozzle 18 connected to a compressor or air pump (not shown). The moistening fluid 14 is wicked by the porous belt 36 as the belt is moves through the reservoir 12. The nozzle 18 is mounted so that it directs air toward the porous belt. The air dislodges fluid 14 wicked by the porous belt 36 and blows the moistening fluid toward the envelope flap 20.

Figure 5:
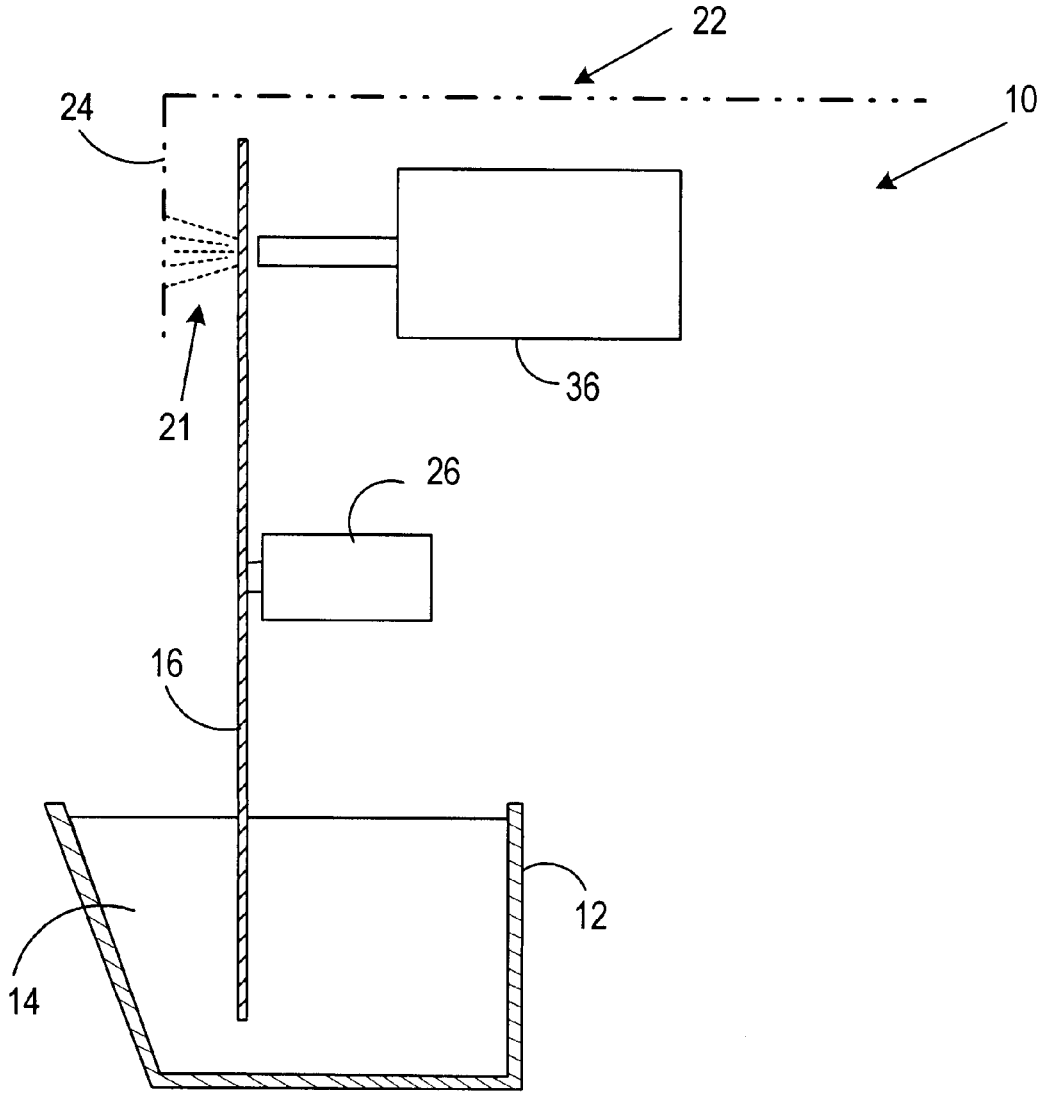
FIG. 5 is a simplified schematic view of an alternate embodiment of the apparatus of the present invention.

FIG. 5 is a simplified schematic view of an alternate embodiment of the apparatus 10 of the present invention. The disk 16 is rotated through fluid 14 in reservoir 12 by a drive means 26. An actuator 36 is positioned adjacent to the disk 16 and vibrates the disk 16 causing the fluid wicked by disk 16 to become projected fluid 21 and to deposit onto envelope flap 24. The actuator can be a piezoelectric actuator that produces displacement when a voltage is applied. In this embodiment, the porous media may be replaced with a wettable media that can be vibrated by the actuator so that the fluid 14 is flicked from the media toward the envelope flap. A wettable media and actuator could also be used in the embodiment of FIG. 4 where the wettable media would be used for the belt 36 and an actuator would replace nozzle 18 and pump.

The envelope flap moistening apparatus of the present invention provides for non-contact flap moistening by affecting movement of tiny droplets off of a porous material and to the envelope flap. Previous non-contact systems use pumps to pump fluid to the envelope flap. Contact systems use a contact media to contact and moisten the envelope flap. Previous systems are subject to contamination. Some systems are also subject to wear. The envelope flap moistening system of the present invention reduces the possibility of projecting means contamination. The present invention can also be facilitated with inexpensive, available components.

While the present invention has been disclosed and described with reference to a single embodiment thereof, it will be apparent, as noted above, that variations and modifications may be made therein. It is also noted that the present invention is not limited to moistening envelopes flaps. Thus, it is intended in the following claims to cover each variation and modification that falls within the true spirit and scope of the present invention.

What is claimed is:

1. An apparatus for delivering moistening fluid to an envelope flap comprising:

a reservoir containing the moistening fluid;

a media partially submerged in the moistening fluid contained in the reservoir, the media wicking a portion of the moistening fluid as the media is moved through the reservoir and the moistening fluid;

a drive means operably connected to the media for moving the media through the reservoir; and a projecting means for projecting moistening fluid from the media, the projecting means positioned adjacent to the media on a side opposite the envelope flap, and near a portion of the media that is not submerged in the reservoir;

whereby when the projection means affects the media, a portion of the moistening fluid that has been wicked by the media is dislodged from the media forming droplets that travel to and moisten the envelope flap.

2. The apparatus as claimed in claim 1 wherein the projecting means is a nozzle connected to an air source for blowing air toward the media and towards the envelope flap.

3. The apparatus as claimed in claim 1 wherein the projecting means is an actuator for causing vibration of the media and causing projection of moistening fluid from the media.

4. The apparatus as claimed in claim 3 wherein the actuator is a piezoelectric actuator.

5. The apparatus as claimed in claim 1 wherein the media is a porous disk.

6. The apparatus as claimed in claim 1 wherein the media is a continuous belt.

7. The apparatus as claimed in claim 1 wherein the air source is a diaphragm pump.

8. The apparatus claimed in claim 1 wherein the media is a mesh.

9. The apparatus as claimed in claim 8 wherein the mesh is polyester.

10. The apparatus claimed in claim 1 further comprising a collection system positioned below the envelope flap for collecting excess moistening fluid.

11. The apparatus claimed in claim 1 wherein the media is a porous media.

12. The apparatus claimed in claim 1 wherein the media is a wettable media.

13. An apparatus for delivering moistening fluid to an envelope flap comprising:

a reservoir for containing moistening fluid, the moistening fluid to be delivered to the envelope flap;

a porous media rotatably mounted above the reservoir, the porous media mounted in alignment with the reservoir such that when the porous media is rotating, a portion of the porous media is submerged in the moistening fluid and another portion of the porous media is in alignment with the envelope flap;

a drive means operably connected to the porous media for moving the porous media through the reservoir; and a nozzle mounted adjacent to the portion of the porous media in alignment with the envelope flap, the nozzle for blowing air in the direction of the porous media such that the air causes moistening fluid contained in the porous media to spray onto the envelope flap.

14. The apparatus as claimed in claim 13 further comprising a diaphragm pump for pumping air through the nozzle.

15. The apparatus claimed in claim 13 wherein the porous media is a mesh.

16. The apparatus claimed in claim 13 wherein the moistening fluid is sealing solution.

17. The apparatus claimed in claim 13 further comprising a collection system positioned below the envelope flap for collecting excess moistening fluid.

18. The apparatus as claimed in claim 13 wherein the porous media is a disk.

19. The apparatus as claimed in claim 13 wherein the porous media is a continuous belt.

20. The apparatus claimed in claim 15 wherein the mesh is polyester.

* * * * *